United States Patent [19]

Gaffney

[11] 4,264,283

[45] Apr. 28, 1981

[54] PUMP FOR LIQUIDS

[75] Inventor: Edward N. Gaffney, West Midlands, England

[73] Assignee: Lucas Industries Limited, Birmingham, England

[21] Appl. No.: 8,531

[22] Filed: Feb. 1, 1979

[30] Foreign Application Priority Data

Feb. 17, 1978 [GB] United Kingdom ..... 6328/78

[51] Int. Cl.[3] ..... F04B 1/30; F01B 13/02

[52] U.S. Cl. ..... 417/269; 91/493; 91/497

[58] Field of Search ..... 91/493, 496; 417/460, 417/462, 269

[56] References Cited

U.S. PATENT DOCUMENTS

| | | | |
|---|---|---|---|
| 1,904,653 | 4/1933 | Davis | 91/494 |
| 1,918,408 | 7/1933 | Lakin-Smith | 417/462 |
| 2,271,570 | 2/1942 | Dandee | 417/273 |
| 2,324,291 | 7/1943 | Dodge | 417/273 |
| 2,528,764 | 11/1950 | Leonard | 91/493 |
| 2,801,596 | 8/1957 | Sewell | 91/493 |
| 3,270,674 | 9/1966 | Allen | 92/12.1 |
| 3,776,667 | 12/1973 | Berglund | 417/536 |

FOREIGN PATENT DOCUMENTS

| | | | |
|---|---|---|---|
| 1238784 | 7/1960 | France | 417/462 |
| 435729 | 5/1948 | Italy | 91/493 |

*Primary Examiner*—William L. Freeh

*Attorney, Agent, or Firm*—Holman & Stern

[57] ABSTRACT

A pump for liquids including a rotor containing bores housing slidable pistons. A stroke member is associated with the pistons and constraining the pistons, when the rotor rotates, to orbit about an axis parallel to the axis of rotation of the rotor. The spacing between the two axes occasions reciprocation of the pistons within their bores to perform a pumping action. Each piston has coupled thereto a U-shaped member within which is engaged a crosshead of the stroke member. The crosshead is movable slidably within the U-shaped member as the pump operates.

5 Claims, 12 Drawing Figures

PUMP FOR LIQUIDS

BRIEF SUMMARY OF THE INVENTION

This invention relates to a pump of the kind including a rotor rotatable about a first axis and containing at least one bore extending radially within the rotor with respect to said first axis, a piston slidably received in said bore, and a stroke member associated with said piston and constraining said piston, when the rotor rotates about said first axis, to orbit about a second axis parallel to said first axis so that said piston reciprocates in said bore through a stroke determined by the spacing between said first and second axes.

A pump of the kind specified having first and second pairs of aligned diametrically opposed pistons received in respective bores in the rotor is disclosed in British Pat. No. 457511. This arrangement is disadvantageous in that the coupling of the pistons to the stroke member is a bulky cumbersome arrangement and in order that the pistons are co-planar the stroke member must be of an undesirable length to provide axially spaced bearing regions for both pairs of pistons. British patent specification No. 426965 illustrates a similar arrangement in which the bearing length of the stroke member is reduced at the expense of offsetting the planes of the pairs of pistons, an expedient which increases the complexity of manufacture of the pump and necessitates an increase in the axial dimensions of at least the rotor and the inlet and outlet parting of the pump. Furthermore the pump constructions disclosed in British patent specifications Nos. 457511 and 426965 are disadvantageous in that they are restricted to even numbers of pistons and in that they utilize pairs of diametrically opposed integrally interconnected pistons.

It is an object of the present invention to provide a pump construction wherein the aforementioned disadvantages are minimised.

In accordance with the present invention, in a pump of the kind specified the piston has coupled thereto a separately formed U-shaped member whose limbs extend parallel to said axes, and said stroke member includes a crosshead engaged by said U-shaped member, said crosshead having a pair of parallel oppositely presented faces co-operating respectively with said limbs of said U-shaped member and rotating, in use, about said second axis as said rotor rotates, whereby as said rotor and said crosshead rotate about their respective axes the piston is caused to reciprocate in said bore, said U-shaped member reciprocating across said surfaces of the crosshead in a direction transverse to said axes.

Preferably the pump includes a second piston diametrically opposite the first mentioned piston and received in a second bore in the rotor diametrically opposite the first mentioned bore, said second piston also being separate from though coupled to said U-shaped member and so reciprocating in unison with said first piston relative to the rotor.

Conveniently said U-shaped member is flexible and the or each piston is coupled to a respective limb thereof extending transversely relative thereto.

Desirably the first and second pistons and the U-shaped member define a first piston assembly, and a second similar piston assembly is provided, said second piston assembly extending co-planar with and at right angles to, said first piston assembly, the limbs of the U-shaped member of the second assembly co-operating with a second pair of parallel surfaces of the crosshead and said limbs of the second member extending in a direction opposite to that of the limbs of the first mentioned member so that the first and second members define a box-like arrangement within which the crosshead is received, said stroke member extending through an aperture in the base wall of one of said first and second U-shaped members.

Alternatively the pump includes a plurality of piston arrangements similar to a first piston arrangement defined by said first and second pistons and said U-shaped member, said arrangements being co-planar and being equiangularly disposed around said second axis, some of the U-shaped members of said arrangements having their limbs extending in an axial direction opposite to that of the limbs of at least one of other U-shaped members and the members defining a cage or enclosure in which said crosshead is received, the crosshead having pairs of parallel surfaces co-operating with the limbs of the U-shaped members and the base wall of at least one of said members having therein an aperture through which the stroke member extends.

Preferably the stroke member is movable to alter the spacing between the first and second axes thereby altering the displacement of the pump.

Desirably the stroke member is movable linearly or substantially linearly so that the angular position of the piston top dead centre position is not materially altered during movement of the stroke member.

Conveniently the stroke member is carried by a pivotted lever and the length of the lever between said second axis and the pivot axis of the lever is sufficiently large in relation to the range of movement which the stroke member is to perform that the path of movement of the stroke member in said range approximates sufficiently closely to linear movement that there is negligible change in the circumferential positions relative to the casing, of the piston top dead centre positions.

DETAILED DESCRIPTION

Figure 1:
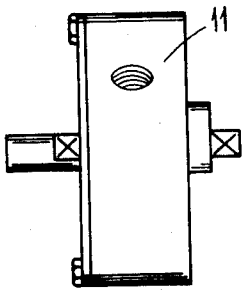
FIG. 1 is a side elevational view of a pump in accordance with one example of the present invention.
Figure 2:
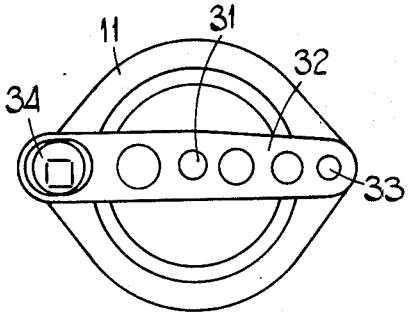
FIG. 2 is an end view of the pump shown in FIG. 1.
Figure 3:
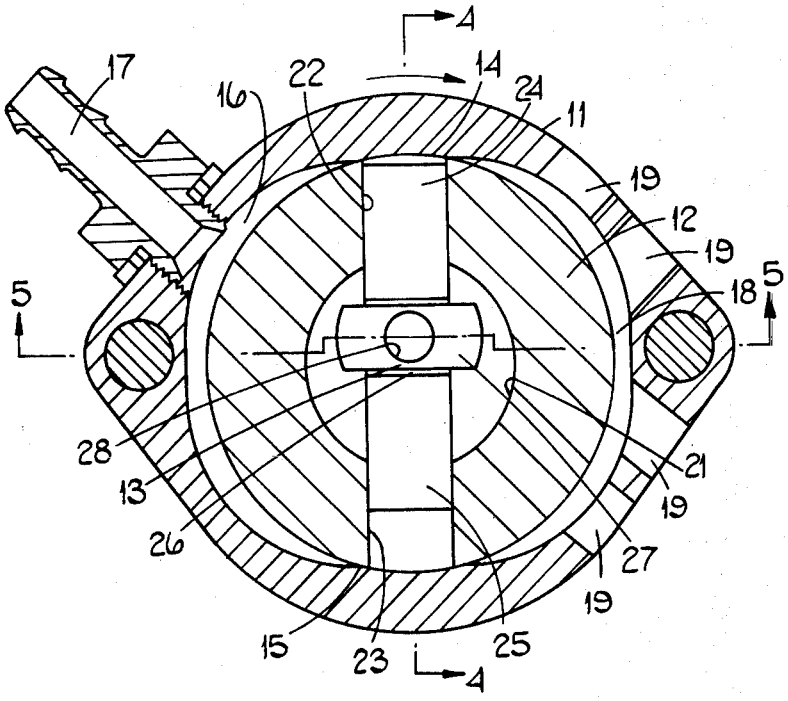
FIG. 3 is a transverse sectional view to an enlarged scale of part of the pump shown in FIG. 1.
Figure 4:
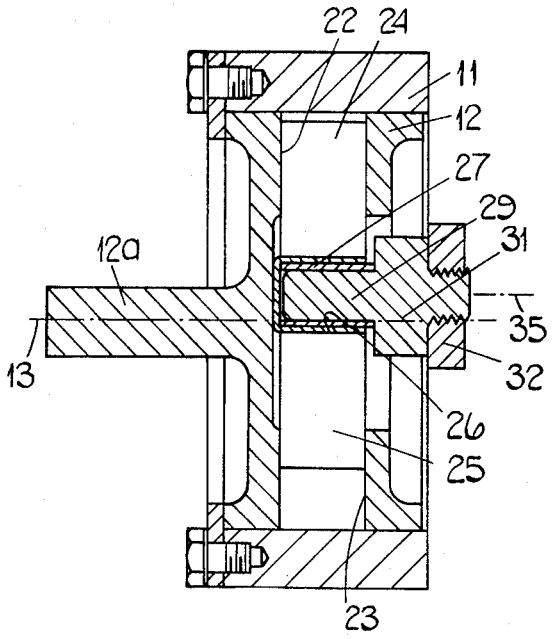
FIGS. 4 and 5 are sectional views on the line 4—4 and 5—5 respectively in FIG. 3.
Figure 5:
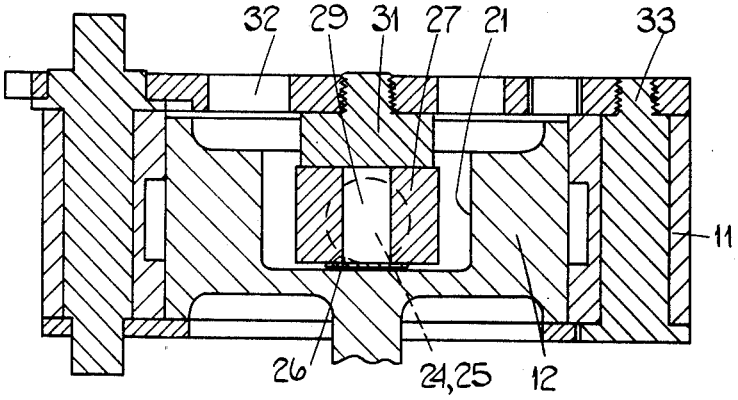

Referring first to FIGS. 1 to 5 of the accompanying drawings, the pump is intended for use as a patrol pump for an internal combustion engine, and is arranged to be mounted immersed in petrol in a petrol tank associated with the internal combustion engine. The pump includes an outer cylindrical casing 11 within which a rotor 12 is mounted for rotation about a first axis 13. The rotor bears against cylindrical parts of the inner wall of the casing 11 at a pair of diametrically opposite regions 14, 15 and to one diametric side of the regions 14, 15 the casing 11 and rotor 12 define between them an outlet chamber 16 communicating with a hollow outlet pipe 17 while to the other side of the diameter of the rotor passing through the regions 14, 15 the rotor and casing define between them an inlet chamber 18 communicating with the interior of the petrol tank by way of four inlet passages 19 in the casing 11. In practice the chambers 16, 18 are permanently full with petrol.

The rotor 12 is generally in the form of a cylindrical block of circular cross-section having a centrally disposed circular recess 21 communicating with a diametrically extending bore of circular cross-section. The diametrically extending bore is divided into two aligned portions 22, 23 by the recess 21, each of the portions 22, 23 being open at one end at the recess 21 and open at their other end at the exterior of the rotor 12.

Slidably disposed in the transverse bore of the rotor 12 is a pair of pistons 24, 25 of circular transverse cross-section the axially aligned pistons 24, 25 being disposed in the bore portions 22, 23 respectively.

The pistons 24, 25 are interconnected at their radially innermost ends by a resilient metal U-shaped member 26, the pistons being secured to the outer faces of the two parallel limbs respectively of the member. The member 26 defines between the pistons a channel within which is slidably received a rectangular bronze cross-head or block 27. The limbs of the member extend in the direction of the axis of rotation of the rotor and the block 27 is thus slidable relative to the pistons 24, 25 in a direction at right angles to the axis of the pistons and at right angles to the axis of rotation of the rotor. The block 27 is formed with a bore 28 which extends at right angles to the axis of the pistons and which rotatably receives a stub-shaft 29 of a member 31 secured to a lever 32. The lever 32 extends generally diametrically across one axial end of the casing 11 and is at one end pivotally connected to the casing 11 by means of a pivot arrangement 33. At its end opposite the pivot arrangement 33 the lever 32 is engaged by a rotatable cam 34 whereby upon rotation of the cam 34 the lever 32 is pivotted relative to the casing 11 about the axis of a pivot post of the arrangement 33. Thus the member 31 and shaft 29 which have their axis 35 parallel to the axis 13 are moved with the lever 32 relative to the casing 11 and rotor 12. The movement of the member 31 and the shaft 29 takes place in a direction which alters the spacing between the axes 13 and while maintaining the axes parallel.

The rotor 12 includes an integral shaft 12*a* whereby the rotor 12 is rotated within the casing 11 about the axis 13. It will be appreciated that the pistons 24, 25 must rotate with the rotor 12 since they are carried in the bores 22, 23. However, the axis about which the interconnected pistons 24, 25 rotate is, by virtue of the stroke member including the block 27 and the stub-shaft 29 and the member 31, the axis 35 and not the axis 13. When the axes 13 and 35 are spaced apart then it will be recognised that the rotation of the rotor 12 results in reciprocatry movement of the interconnected pistons 24, 25 within their respective bore portions 22, 23. Furthermore, since the pistons are interconnected then they will permanently be 180° out of phase, that is to say when the piston 24 is at the end of its stroke which can be considered as the top dead centre position, in relation to its bore portions 22 then the piston 25 will be in the position which can be considered as the bottom dead centre position in relation to its bore portion 23.

It will be apparent that the stroke of reciprocatry movement of the pistons is determined by the spacing between the axes 13, 35 and that this spacing is controlled by the angular position of the lever 32 about its pivot arrangement 33. Thus rotation of the cam mechanism 34 alters the stroke of the pistons 24, 25. It will be appreciated that if desired a situation can be arranged whereby the axes 13, and 35 are coincident, in which case the pistons will have a zero stroke.

The mechanism is so arranged that as the outer end of each bore traverses the chamber 18 then the piston will be retracting so drawing fuel from the chamber 18 into its respective bore portion, and while each bore portion is traversing the chamber 16 the respective piston will be expelling fuel from the bore portion to the chamber 16, and thus from the chamber 16 by way of the outlet 17.

The two piston pump described above is satisfactory for many application, but can be considered to suffer from a minor disadvantage in that the output from the pump consists of two output pulses for each revolution of the rotor. In order to provide a smoother output the number of pistons can be increased, and FIGS. 6 to 9 illustrate a four piston arrangement which will of course have four pulses per revolution of the rotor. Since the pulses overlap one another then of course a smoother output characteristic is achieved.

The basic principle of the four piston arrangement is extremely similar to the two piston arrangement described above the pump including casing 41 rotatably housing a cylindrical rotor 42. Outlet and inlet chambers 46, 48 are defined on opposite sides of the rotor, the outlet chamber 46 having an outlet pipe 47 and the inlet chamber 48 communicating with the fuel tank by way of passages 49 in the casing 41. The chambers 46, and 48 are separated by lands 44, 45 whose surface is part of a cylinder having its axis on the axis of the rotor 42. The rotor has a centrally disposed axially extending recess 51 and is provided with a pair of diametrically extending bores positioned at right angles to one another and each divided into a pair of portions by the recess 51. Thus there are four bore portions 52, 53 and 152, 153 respectively. Each of the bore portions receives a respective piston 54, 55 and 154, 155 respectively. The pistons 54, 55 are interconnected by way of a U-shaped metal carrier 50 the pistons 54, 55 being secured to opposite limbs and extending outwardly therefrom at right angles to the limbs. The pistons 154, 155 are similarly interconnected by means of a U-shaped metal carrier 150 (FIG. 8) and the two carriers 50 and 150 are positioned with respect to one another so as to define a box-like member, substantially a hollow cube with aligned positions 54, 55 co-planar with and at right angles to the aligned pistons 154, 155. A bronze cross-head or block 57 having a centrally disposed bore 58 is disposed between the U-shaped members 50 and 150.

The base portion of the member 50 being formed with a circular aperture 50*a* aligned with the bore 58 and whereby a stub-shaft of a member equivalent to the member 31 of the previous example can be rotatably engaged in the bore 58.

The circumferential length of each of the lands 44, 45 is greater than the diameter of each of the bores 52, 53, 152, 153 to prevent communication between the high pressure and low pressure sides of the pump as each bore traverses a land 44. However to ensure that the pump does not lock at start-up owing to an outwardly moving piston being aligned with a land 44, 45 each land is formed with bleed grooves 61 to allow liquid trapped between a piston and the land to be displaced from the bore.

The operation of the pump and the variation in the stroke of the pistons, and thus the output of the pump is exactly as described above with reference to the first example, with the exception of course that four pistons are involved, the pairs of pistons sliding relative to one another and the block 57 by virtue of the U-shaped members 50 and 150 during rotation of the rotor 42.

Figure 6:
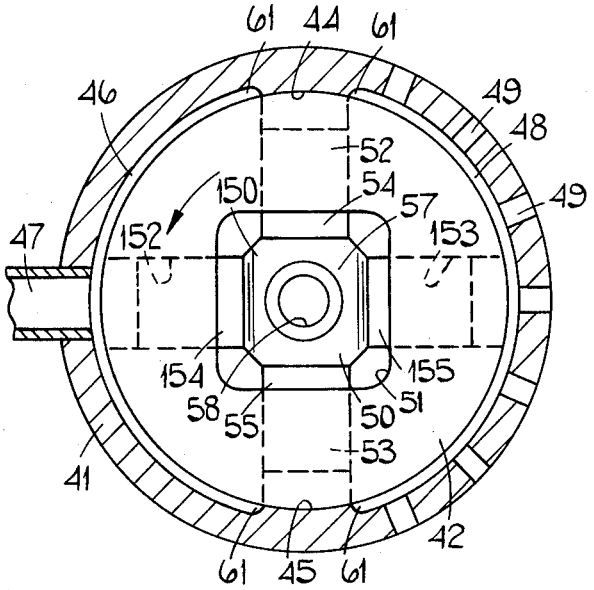
FIG. 6 is a diagrammatic representation of a pump in accordance with a second example of the present invention.
Figure 7:
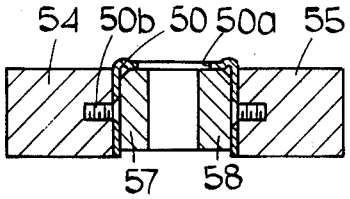
FIG. 7 is a diagrammatic representation of part of the piston arrangement of the pump shown in FIG. 6.
Figure 8:
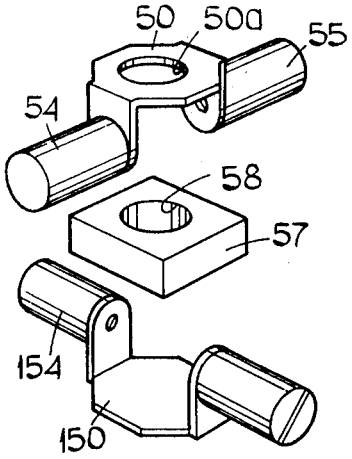
FIG. 8 is a perspective view of the piston arrangement of the pump of FIG. 6.

In order to assemble the arrangement shown in FIG. 6 to 8 the limbs of the U-shaped members 50 and 150 are provided with captive screws 50*b* (FIG. 7). The four pistons are inserted into their respective bore portions prior to insertion of the rotor into the casing, and the U-shaped metal chamber 150 is then positioned with its base part foremost in the recess 51 of the rotor 42. The pistons are provided in their outermost end faces with screw driver slots and in their innermost ends with screw threaded bores for receiving the screws 50*b*. The two pistons 154, 155 are pushed inwardly of their bores to engage the respective screws 50*b* of the member 150 and the pistons are then rotated by means of screw drivers to screw the pistons onto the screws 50*b*. The block 57 is then inserted between the limbs of the U-shaped member 150 and the U-shaped member 50 is then positioned at right angles to the member 150 and is inserted with its limbs foremost into the recess 51, the limbs passing on opposite sides of the block 57. The pistons 54, 55 are then secured to their screws 50*b* in the same manner as the pistons 154, 155. The rotor can then be introduced into the casing 11 and the stroke adjustment mechanism can be assembled to the casing, the stub-shaft of the member secured to the lever being inserted through the aperture 50*a* in the member 50 and into the bore 58 of the block 57.

Figure 9:
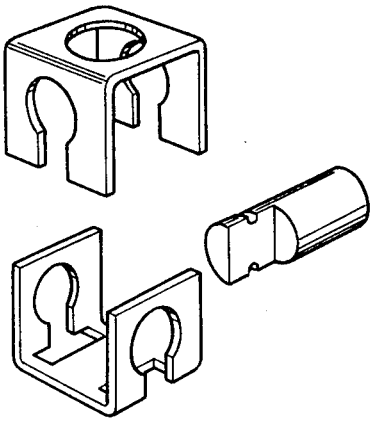
FIG. 9 is a perspective view of part of an alternative form of piston arrangement for use in the pump of FIG. 6.

FIG. 9 illustrates a modification of the U-shaped metal members interconnecting the pistons wherein the pistons are provided adjacent their innermost end with a peripheral groove and the U-shaped members are formed with keyhole slots in which the grooves portions of the pistons locate. The pistons are engaged with their carrier member by flexing the carrier to open the keyhole slots, inserting the pistons into the slots with the material of the carrier engaging in the grooves of the pistons and then allowing the carrier to flex back to its original configuration with the pistons located in the circular parts of the keyhole slots.

Figure 10:
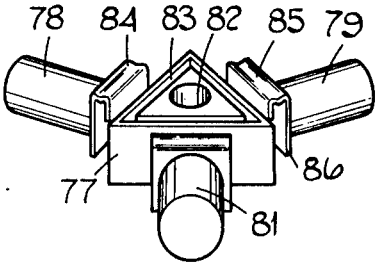
FIG. 10 is a diagrammatic representation of an alternative form of piston arrangement.
Figure 11:
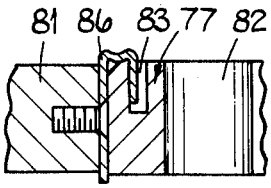
FIG. 11 is a sectional view of part of the arrangement shown in FIG. 10.

FIGS. 10 and 11 illustrate an alternative arrangement wherein the pump includes three pistons equi-angularly disposed about the axis of the rotor. The rotor of course has three equi-angularly spaced bores defining the cylinders within which the pistons reciprocate.

Referring to FIGS. 10 and 11, the principle difference between the three piston version and the four piston version described previously lies in the shaping of the crosshead 77 and the way in which the pistons 78, 79, 81 co-operate with the crosshead. The crosshead 77 is again formed from bronze and is in the form of a block having a cross-sectional shape of an equilateral triangle. The block is formed with an axially extending bore 82, centrally disposed within the triangle, and arranged to receive the stub-shaft of the remainder of the stroke member in use. Extending around the bore 82 is a channel 83, the channel 83 being in the form of an equilateral triangle concentric with the triangular shape of the crosshead itself. The groove 83 can thus be considered to have three outermost surfaces, these three outermost surfaces being parallel with the three outer surfaces of the block itself. Each of the pistons 78–81 has a sheet metal clip 84–86 secured to its radially innermost end, the three clips being generally U-shaped having one of their limbs secured to the radially innermost face of the respective piston, and the other, parallel limb extending down into a respective straight region of the groove 83. The internal spacing between the limbs of the clips is equal to the wall thickness of the crosshead 77, that is to say the thickness between an outersurface of the crosshead 77 and the corresponding face of the groove 83. As with all of the previously described examples, the clip associated with each piston can thus slide relative to the crosshead along the length of the corresponding surfaces of the crosshead, such sliding movement occuring during rotation of the rotor of the pump when the axis of rotation of the crosshead is spaced from the axis of rotation of the rotor.

In a further modification, (not shown) the crosshead of a three-piston version of the pump is more similar to the crosshead 57 described above with the exception that the crossectional shape is that of a hexagon rather than a square. The clips associated with each of the three pistons are similar to the clips 50 in that the block lies between the limbs of each clip, but of course in a three-piston version only one of the limbs of each clip will carry a piston.

Figure 12:
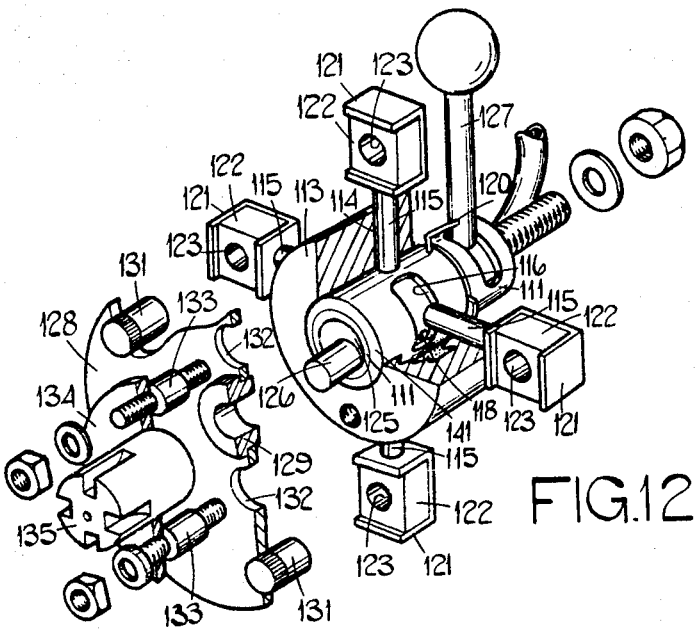
FIG. 12 is a perspective representation of a further alternative pump construction.

In an alternative construction, illustrated in FIG. 12, the pistons rather than extending radially outwardly of the rotor extend radially inwardly. Thus the pump includes a rotor 113 having equiangularly spaced radial bores 114, the rotor being mounted for rotation on a central hub assembly 125, 141. At its outer end each of the pistons 115 carries a U-shaped metal clip 121 the piston 115 being secured to one limb of its respective clip. The open faces of the four clips 121 are presented to one axial end of the assembly, and between the limbs of each clip is slidably disposed a square crosshead 122 having a central bore 123. The four bores 123 are thus parallel to the rotational axis of the rotor 113. The inner ends of the bores 114 communicate with recesses 116 in the hub assembly, the recesses 116 being defined by apertures in a sleeve 141 rotatably disposed on a fixed shaft 111. Extending through the shaft 111 with its axis parallel to but spaced from the axis of the shaft 111 is a spindle 125 having a stub-axle 126 projecting from its one end. The axis of the stub-axle 126 is parallel to but spaced from the axis of the spindle 125. A lever 127 is connected to the spindle 125 and facilitates rotation of the spindle 125 within the shaft 111. A connecting link 120 connects the lever 127 to the sleeve 141 so that the spindle 125 and sleeve 141 rotates as one relative to the shaft 111.

The stub-axle 126 is rotatably received in a bush 129 of a plate 128. The plate 128 forms part of the stroke member of the pump and carries four axially extending equi-angularly spaced posts 131 each of which is received in the bore 123 of a respective crosshead 122. It will be recognised that angular movement of the spindle 125 relative to the shaft 111 will result in lateral movement of the plate 128 relative to the axis of rotation of the rotor. The plate 128 rotates with the rotor 113 but since its rotational axis is determined by the axis of the stub-axle 126 then as with the previously described pumps the spacing between the axis of rotation of the stroke member 128, 131, 122 and the axis of rotation of the rotor 113 will determine the stroke of the pistons 115 in their bores 114. It will be recognised that at the crossheads rotatable with the plate 128 about the axis of the stube axle 126 they will reciprocate angularly on their respective post 131 as they slide within the respective clips 121.

A drive member 135 is coupled by way of a plate 134 and bolts 133 to the rotor 113, the bolts 133 passing through enlarged apertures 132 in the plate 128 of the stroke member. Rotation of the rotor 113 is effected by way of the drive member 135.

The shaft 111 is formed with a pair of axially extending passages each of which communicates respectively with a recess 116. The recesses 116 are swept by the innermost ends of the bores 114 as the rotor rotates, and thus the recesses 116 and their corresponding passages 118 constitute the inlet and outlet arrangement of the pump. Since the sleeve 141 is moved angularly with the spindle 125 during adjustment of the stroke of the pump then any angular variation in the bottom dead centre positions of the pistons, relative to the shaft 111, does not entail a shift in the bottom dead centre positions of the pistons relative to their inlet and outlet recesses 116 since the recesses 116 are moved angularly with the spindle 125 during stroke adjustment.

It is contemplated that all of the various pump constructions described above can be used in a system which requires intermitent operations of the pump. In such systems the stroke control mechanism will be so arranged that it is capable of achieving a position wherein the pistons have a zero stroke length. It will be recognised that in such conditions the pump does not produce any output even though the rotor is rotating, and thus the load applied by the pump to the drive mechanism is minimised.

It follows therefore that in such a system, provided that the zero stroke condition is achieved during starting then the starting torque which must be provided by the drive mechanism will be minimal. Once the pump is running then the stroke can be progressively increased by operation of the stroke adjusting mechanism to produce the desired output. Moreover, the stroke adjustment mechanism can, if desired, be linked to some form of feedback arrangement which ensures that the pump output is maintained at a preset value, the stroke adjustment mechanism being adjusted automatically as the demands at the output vary. For example the lever 32 could be spring biassed to a predetermined position to achieve a particular output pressure. Should the output pressure vary as a result of, for example, a variation in demand then since the output pressure is applied back through the pistons to the lever 32, the lever 32 will move automatically to a position wherein equilibrium between the spring acting on the lever 32 and the output pressure is restablished. When the output pressure rises the lever will move under the action of the spring to reduce the pump output and when the pressure fails, the lever will move to increase the output. I claim:

1. A pump including a body, a rotor within said body rotatable about a first axis, an axially extending recess in said rotor, first, second, third and fourth radially extending bores in said rotor, said bores communicating at their radially innermost ends with said axially extending recess, and said bores being arranged with their axes in a common plane lying at right angles to said first axis, said first and second bores being diametrically opposite one another, and said third and fourth bores being diametrically opposite one another, first and second pistons slidable in said first and second bores respectively, said first and second pistons being interconnected by a first link member which extends across said axially extending recess of the rotor, said first link member being spaced laterally from the common axis of said first and second pistons whereby the first and second pistons and the first link member define a first piston unit having therein, between the pistons, a channel the base of which is defined by said first link member, and having parallel walls which extend at right angles to the common axis of the first and second pistons, a second piston unit similar to said first piston unit, and defined by third and fourth pistons slidable in said third and fourth bores respectively and a second link member similar to said first link member interconnecting said third and fourth pistons, a stroke member operatively associated with said first and second piston units, and constraining said first and second piston units, when said rotor rotates about said first axis, to orbit about a second axis parallel to said first axis so that said pistons reciprocate in their respective bores through a stroke determined by the spacing between said first and second axes, said stroke member including a cross head engaged in the channels of said first and second piston units, said cross head being rotatable about said second axis and having a first pair of parallel oppositely presented surfaces cooperating respectively with the parallel walls of the channel of the first piston unit, and having a second pair of parallel oppositely presented surfaces cooperating respectively with the parallel walls of the channel of the second piston unit, whereby, as said rotor and said cross head rotate about the first and second axes respectively the parallel walls of the channels of said first and second piston units reciprocate across the respective surfaces of the cross head in a direction transverse to said first and second axes, and, said first and second piston units being orientated with their channels presented in opposite directions whereby said cross head is received within the channels of the first and second piston units, with the first link member passing to one side of the cross head and the second link member passing to the opposite side of the cross head whereby the first and second piston units define a box-like arrangement within which the cross head is received, an aperture in one side of first and second link members through which said stroke member extends into engagement with said cross head.

2. A pump as claimed in any one of the preceding claims wherein said first and second link members each comprise a resilient U-shaped member, the first and second pistons being coupled to respective parallel limbs of the first U-shaped member, said limbs extending transversely relative to said first and second pistons, and said third and fourth pistons being coupled to respective parallel limbs of the second U-shaped member, said limbs extending transversely relative to said third and fourth pistons.

3. A pump as claimed in claim 1 wherein said stroke member is movable to alter the spacing between the first and second axes thereby altering the displacement of the pump.

4. A pump as claimed in claim 3 wherein said stroke member is movable linearly or substantially linearly so that the angular position of the piston top dead centre position is not materially altered during movement of the stroke member.

5. A pump as claimed in claim 4 wherein the stroke member is carried by a lever pivotally mounted on said body, the length of said lever between said second axis and the pivot axis of the lever being sufficiently large in relation to the range of movement which the stroke member is to perform that the path of movement of the stroke member in said range approximates sufficiently closely to linear movement that there is negligible change in the circumferential positions relative to the casing, of the piston top dead centre positions.

* * * * *

Dedication 4,264,283.—*Edward N. Gaffney,* West Midlands, England. PUMP FOR LIQUIDS. Patent dated Apr. 28, 1981. Dedication filed Mar. 1, 1982, by the assignee, *Lucas Industries Ltd.*

Hereby dedicates to the Public all claims of said patent.

[*Official Gazette May 25, 1982.*]

UNITED STATES PATENT AND TRADEMARK OFFICE

CERTIFICATE OF CORRECTION

PATENT NO. : 4,264,283

DATED : April 28, 1981

INVENTOR(S) : Edward N. Gaffney

It is certified that error appears in the above—identified patent and that said Letters Patent is hereby corrected as shown below:

The Title Page should appear as shown on the attached sheet.

Signed and Sealed this

*Twenty-second* Day of *June 1982*

[SEAL]

*Attest:*

GERALD J. MOSSINGHOFF

*Attesting Officer*

*Commissioner of Patents and Trademarks*

United States Patent [19]

Gaffney

[11] 4,264,283

[45] Apr. 28, 1981

[54] PUMP FOR LIQUIDS

[75] Inventor: Edward N. Gaffney, West Midlands, England

[73] Assignee: Lucas Industries Limited, Birmingham, England

[21] Appl. No.: 8,531

[22] Filed: Feb. 1, 1979

[30] Foreign Application Priority Data

Feb. 17, 1978 [GB] United Kingdom ..... 6328/78

[51] Int. Cl.[3] ..... F04B 1/30; F01B 13/02

[52] U.S. Cl. ..... 417/269; 91/493; 91/497

[58] Field of Search ..... 91/493, 496; 417/460, 417/462, 269

[56] References Cited

U.S. PATENT DOCUMENTS

| | | | |
|---|---|---|---|
| 1,904,653 | 4/1933 | Davis | 91/494 |
| 1,918,408 | 7/1933 | Lakin-Smith | 417/462 |
| 2,271,570 | 2/1942 | Dandee | 417/273 |
| 2,324,291 | 7/1943 | Dodge | 417/273 |
| 2,528,764 | 11/1950 | Leonard | 91/493 |
| 2,801,596 | 8/1957 | Sewell | 91/493 |
| 3,270,674 | 9/1966 | Allen | 92/12.1 |
| 3,776,667 | 12/1973 | Berglund | 417/536 |

FOREIGN PATENT DOCUMENTS

| | | | |
|---|---|---|---|
| 1238784 | 7/1960 | France | 417/462 |
| 435729 | 5/1948 | Italy | 91/493 |

*Primary Examiner*—William L. Freeh

*Attorney, Agent, or Firm*—Holman & Stern

[57] ABSTRACT

A pump for liquids including a rotor containing bores housing slidable pistons. A stroke member is associated with the pistons and constraining the pistons, when the rotor rotates, to orbit about an axis parallel to the axis of rotation of the rotor. The spacing between the two axes occasions reciprocation of the pistons within their bores to perform a pumping action. Each piston has coupled thereto a U-shaped member within which is engaged a crosshead of the stroke member. The crosshead is movable slidably within the U-shaped member as the pump operates.

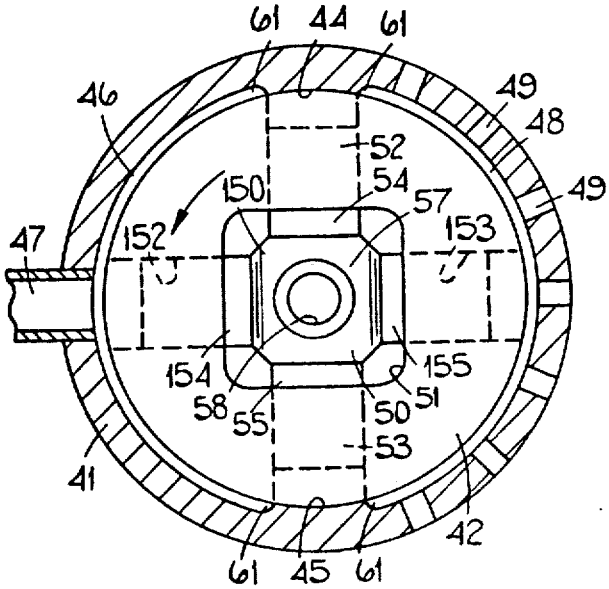

5 Claims, 12 Drawing Figures